US006742645B2

(12) United States Patent
Chou

(10) Patent No.: US 6,742,645 B2
(45) Date of Patent: Jun. 1, 2004

(54) PAPER CURRENCY RECEIVING SYSTEM FOR A TICKET VENDOR OR THE LIKE

(75) Inventor: Shang-Ter Chou, Taoyuan (TW)

(73) Assignee: International Currency Technologies Corporation, Taipei (TW)

( * ) Notice: Subject to any disclaimer, the term of this patent is extended or adjusted under 35 U.S.C. 154(b) by 281 days.

(21) Appl. No.: 10/015,746

(22) Filed: Dec. 17, 2001

(65) Prior Publication Data

US 2003/0111318 A1 Jun. 19, 2003

(51) Int. Cl.[7] ..... G07F 7/04
(52) U.S. Cl. ..... 194/206; 194/350; 902/12
(58) Field of Search ..... 194/206, 207, 194/350; 271/181, 180, 177; 221/198; 209/534; 902/12, 13

(56) References Cited

U.S. PATENT DOCUMENTS 4,880,096 A * 11/1989 Kobayashi et al. ..... 194/206
6,435,329 B1 * 8/2002 Amari et al. ..... 194/206

* cited by examiner

*Primary Examiner*—F. J. Bartuska
(74) *Attorney, Agent, or Firm*—Rabin & Berdo, P.C.

(57) ABSTRACT

A paper currency receiving system is constructed to include a paper currency take-up unit adapted for taking up paper currency inserted therein, a paper currency verification unit inserted into the paper currency take-up unit at a bottom side and adapted for verifying authenticity of inserted paper currency, the paper currency verification unit having two coupling spring plates adapted for securing the paper currency verification unit to the paper currency take-up unit, and a paper currency storage cabinet attached to the paper currency take-up unit at a back side and adapted to collect paper currency from the paper currency take-up unit, the paper currency take-up unit having a spring latch adapted for locking the paper currency storage cabinet and a control button adapted for disengaging the spring latch from the paper currency storage cabinet.

5 Claims, 11 Drawing Sheets

PAPER CURRENCY RECEIVING SYSTEM FOR A TICKET VENDOR OR THE LIKE

BACKGROUND OF THE INVENTION

1. Field of the Invention

The present invention relates to a paper currency receiving system for use in a ticket vending machine, money exchange machine, or the like and, more particularly to such a paper currency receiving system, which comprises a paper currency take-up unit, a paper currency verification unit, and a paper currency storage cabinet, where the paper currency verification unit and the paper currency storage cabinet are detachably coupled to the paper currency take-up unit.

2. Description of the Related Art

A variety of ticket vending machines have been disclosed, and intensively used in parking lots, stations, public facilities for receiving paper currency and vending tickets. A regular ticket vending machine is generally comprised of a paper currency take-up unit adapted for taking up inserted paper currency, a paper currency verification unit adapted for verifying the authenticity of inserted paper currency, and a paper currency storage cabinet adapted for collecting verified paper currency. These three units are fixedly fastened together by screws. When removing the paper currency storage cabinet from the paper currency take-up unit for picking up collected paper currency, the worker must use a screwdriver to unfasten the respective screws. After collection of paper currency, the worker must attach the paper currency storage cabinet to the paper currency take-up unit and then fasten up the respective screws to fixedly secure the paper currency storage cabinet and the paper currency take-up unit again. It is complicated and time-consuming to load and unload the paper currency storage cabinet.

SUMMARY OF THE INVENTION

The present invention has been accomplished to provide a paper currency receiving system, which eliminates the aforesaid problem. According to one aspect of the present invention, the paper currency receiving system the paper currency storage cabinet and the paper currency verification unit are respectively detachably coupled to the paper currency take-up unit, so that the user can easily quickly detach the paper current storage cabinet or the paper currency verification unit from the paper current take-up unit. According to another aspect of the present invention, the paper currency take-up unit comprises a spring latch adapted for locking the paper currency storage cabinet, and a control button for operation by hand to disengage the spring latch from the paper currency storage cabinet. According to still another aspect of the present invention, the paper currency storage cabinet has a top open side (the access hole) closed by a hinged top cover. When the top cover opened, the user can pick up collected paper currency from the paper currency storage cabinet.

DETAILED DESCRIPTION OF THE PREFERRED EMBODIMENT

Figure 1:
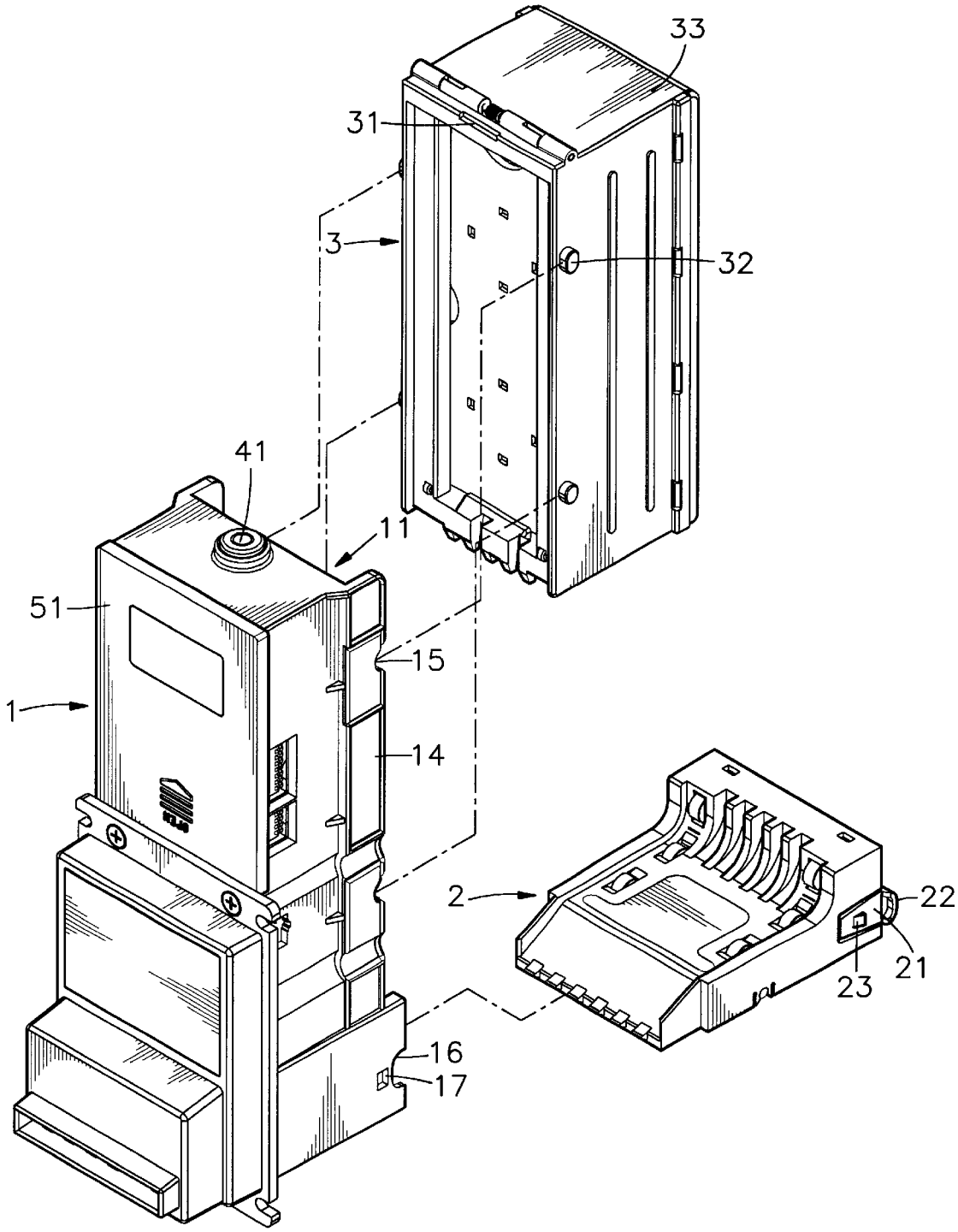
FIG. 1 is an exploded view of a paper currency receiving system constructed according to the present invention.

Referring to FIG. 1, a paper currency receiving system in accordance with the present invention is generally comprised of a paper currency take-up unit 1, a paper currency verification unit 2, and a paper currency storage cabinet 3. The paper currency verification unit 2 is fastened to the backside of the paper currency take-up unit 1 at the bottom. The paper currency storage cabinet 3 is fastened to the backside of the paper currency take-up unit 1 and disposed above the paper currency verification unit 2. The internal mechanism of the paper currency take-up unit 1, the internal paper currency verification module of the paper currency verification unit 2, and the internal structure of the paper currency storage cabinet 3 are of the known art and not within the scope of the present invention, therefore no further detailed description of the related mechanisms and module is necessary.

Figure 2:
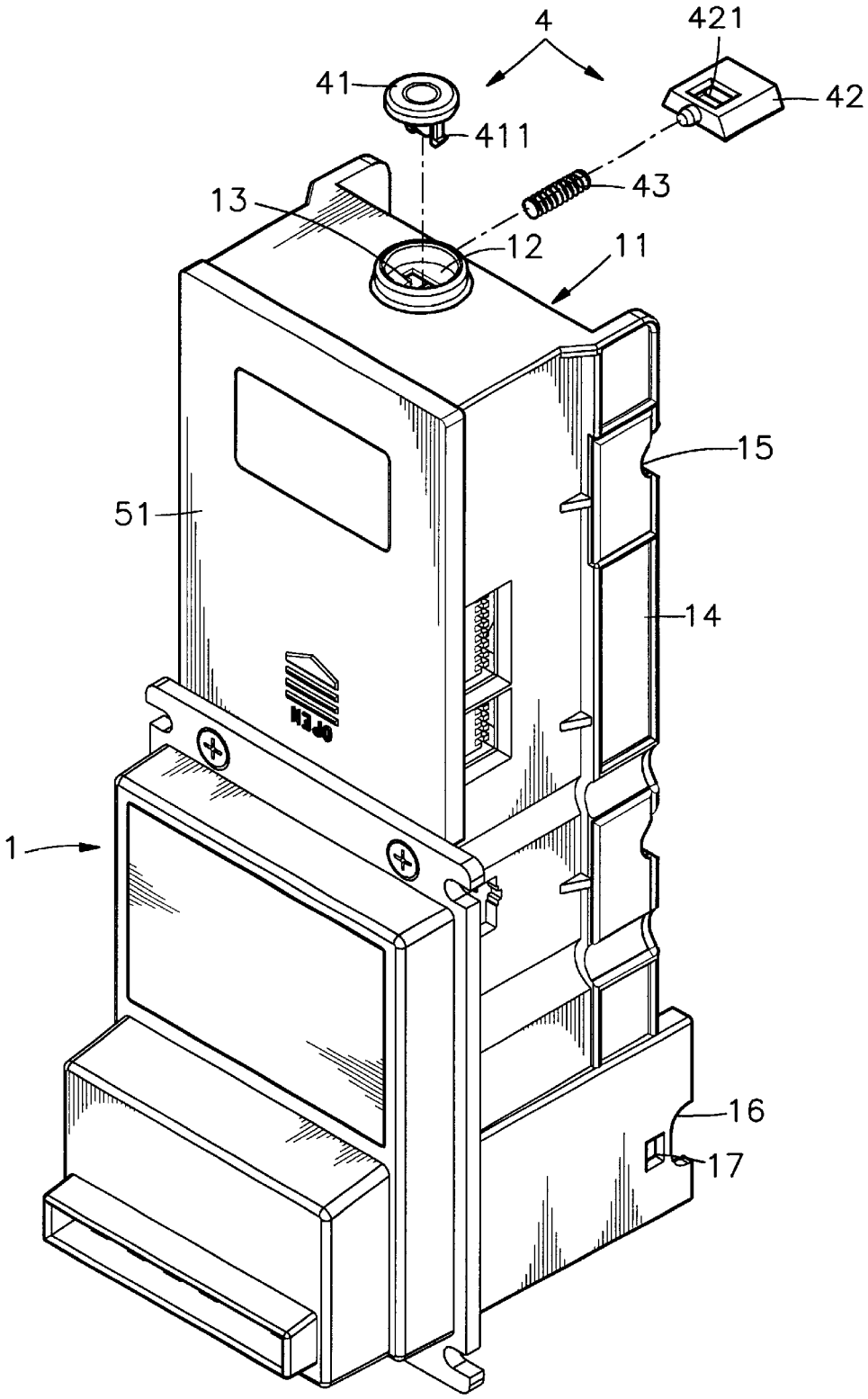
FIG. 2 is an elevational view, partially exploded, of the paper currency receiving system according to the present invention.
Figure 4A:
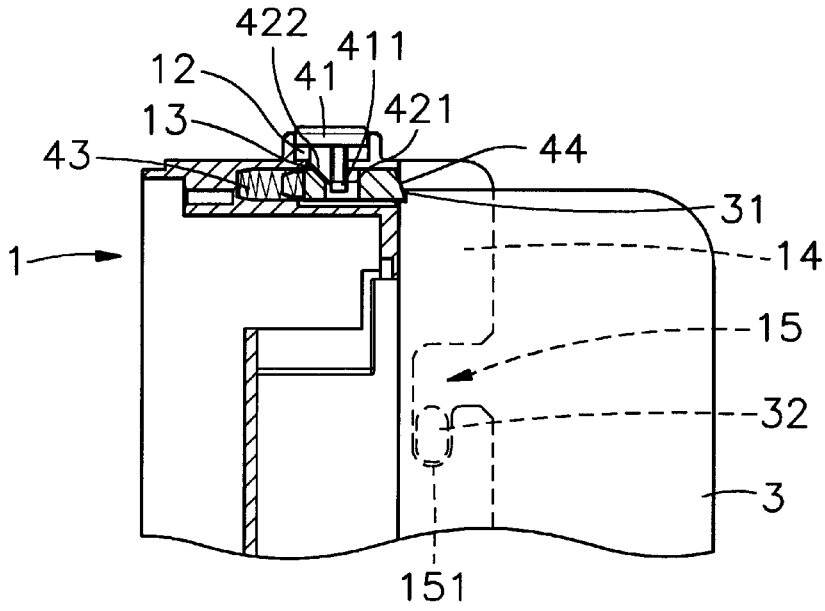
FIG. 4A is a sectional view of a part of the present invention showing the paper currency storage cabinet fastened to the paper currency take-up unit.

The main features of the present invention are outlined hereinafter with reference to the annexed drawings. As illustrated in FIGS. 2 and 4A, the paper currency take-up unit 1 comprises a top chamber 11, a top hole 13 in the top panel 12 of the top chamber 11, two coupling flanges 14 extended along two opposite lateral sides of the back sidewall of the top chamber 11, a plurality of L-shaped locating notches 15 symmetrically disposed in the coupling flanges 14, and a plurality of retaining holes 151 symmetrically disposed in the coupling flanges 14 and respectively connected to the L-shaped locating notches 15. The paper currency storage cabinet 3 fits the space defined between the coupling flanges 14 of the paper currency take-up unit 1, comprising a plurality of locating pegs 32 symmetrically provided at the two opposite lateral sidewalls thereof near the back side (the side facing the paper currency take-up unit 1), and a shoulder 31 backwardly protruded from the top of the back sidewall thereof. Further, a lock 4 is installed in the top hole 13 and adapted for locking the paper currency storage cabinet 3. The lock 4 comprises a spring member 43 mounted inside the top chamber 11, a latch block 42 supported on the spring member 43, and a control button 41 mounted in the button hole 13 and disposed outside the top panel 12 of the top chamber 11 and adapted for moving the latch block 42 between the locking position and the unlocking position. The latch block 42 comprises a top coupling hole 421, a beveled guide face 422 disposed in the top coupling hole 421, and a front tongue 44 forwardly protruded from the front side thereof. The control button 41 is suspended above the button hole 13, having two bottom hooks 411 inserted through the button hole 13 and hooked in the top coupling hole 421 of the latch block 42. After installation of the lock 4, the spring member 43 imparts a forward pressure to the latch block 42, supporting the latch block 42 in the locking position. When attaching the paper currency storage cabinet 3 to the paper currency take-up unit 1, the pegs 32 of the paper currency storage cabinet 3 are respectively inserted into the L-shaped locating notches 15 and engaged into the retaining holes 151. When set into position, the shoulder 31 is stopped at the bottom side of the front tongue 44 of the latch block 42, and therefore the paper currency storage cabinet 3 is prohibited from being moved upwardly from the retaining holes 151 to the L-shaped locating notches 15, i.e., the paper currency storage cabinet 3 is locked.

Figure 4B:
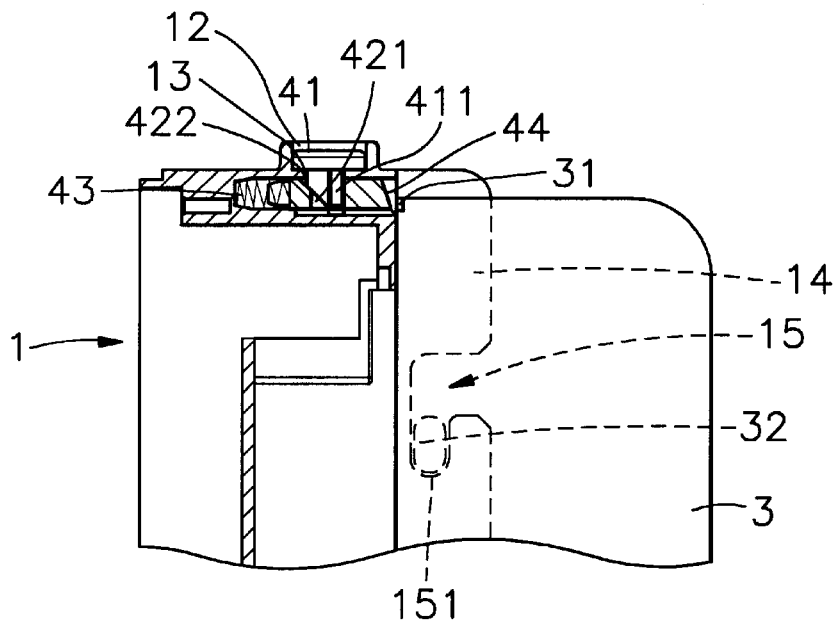
FIG. 4B is similar to FIG. 4A but showing the control button of the lock depressed, the latch block disengaged from the shoulder of the paper currency storage cabinet.
Figure 4C:
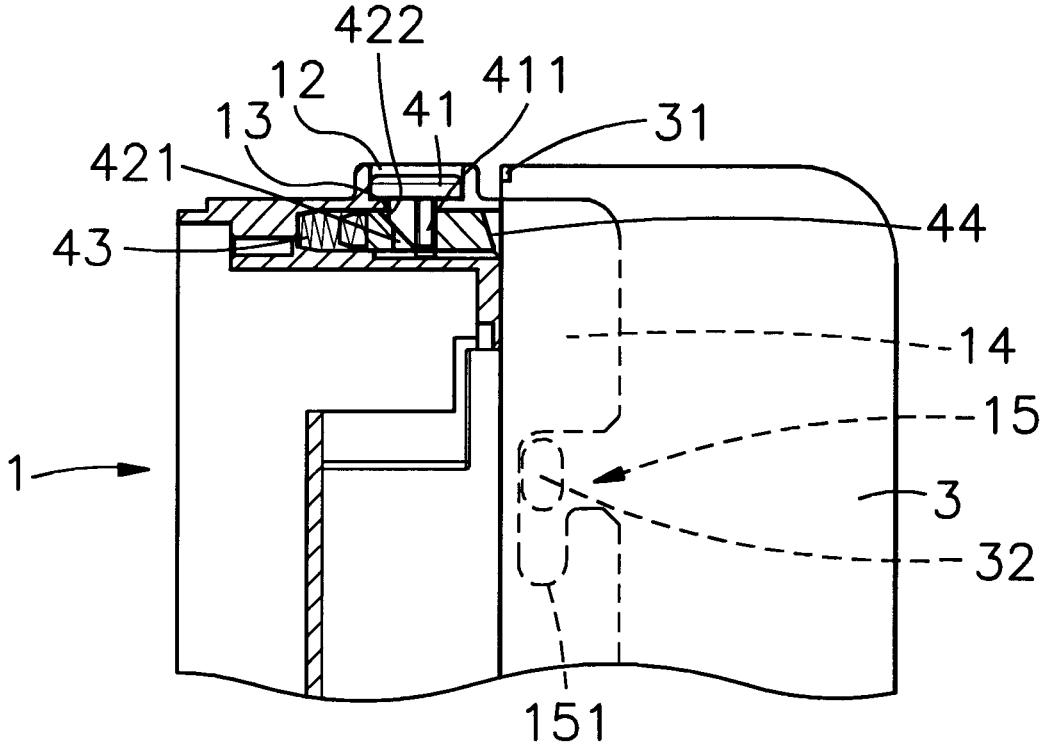
FIG. 4C is similar to FIG. 4B but showing the paper currency storage cabinet lifted, the pegs disengaged from the corresponding retaining holes.
Figure 5:
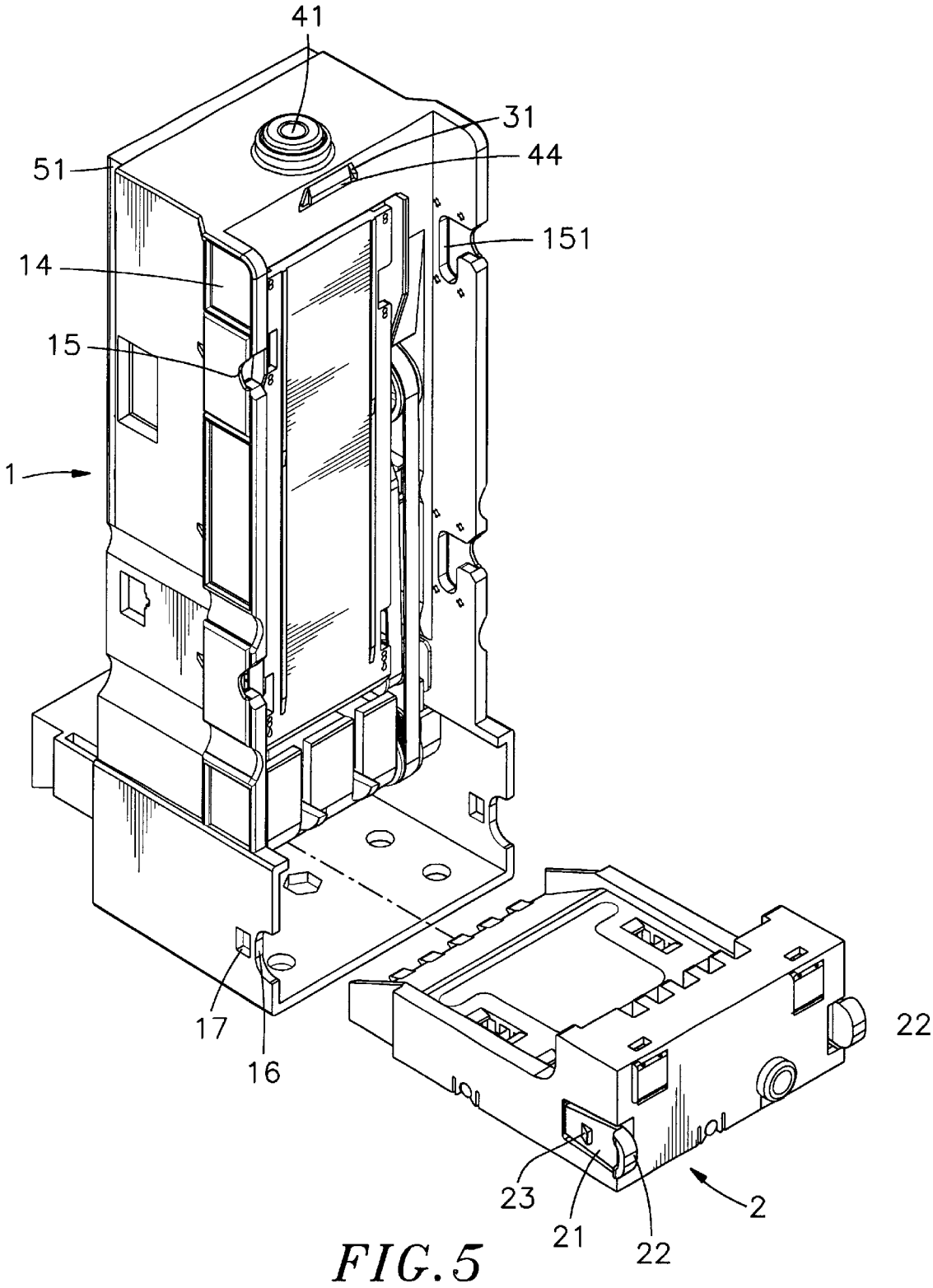
FIG. 5 is an exploded view of a part of the present invention showing the relation between the paper currency take-up unit and the paper currency verification unit.
Figure 6A:
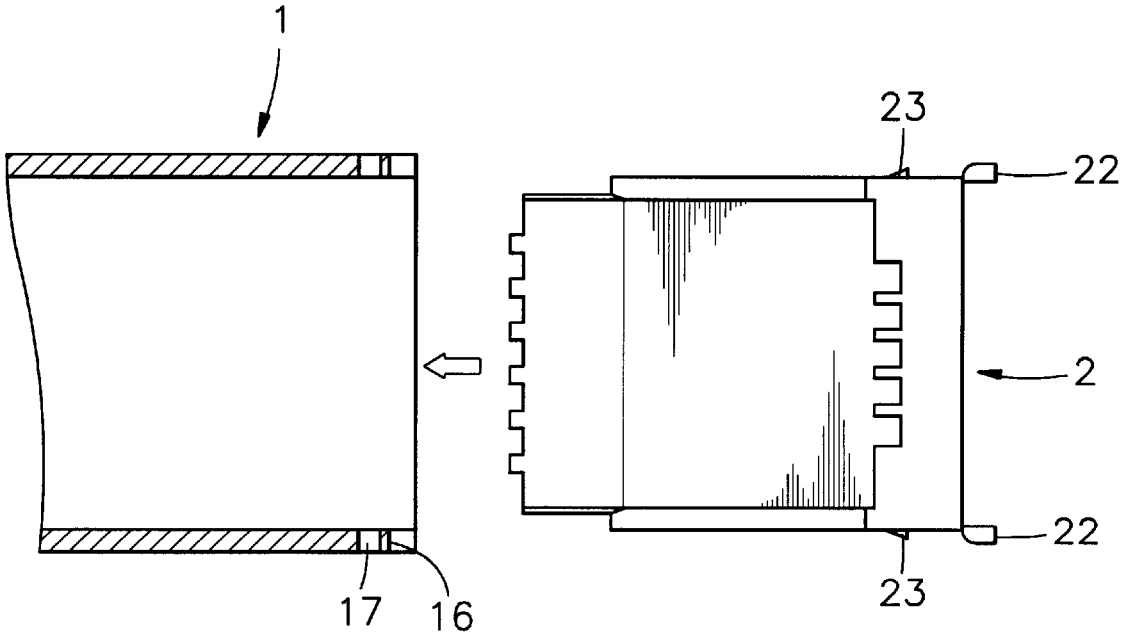
FIG. 6A is a top view in section of FIG. 5.
Figure 6B:
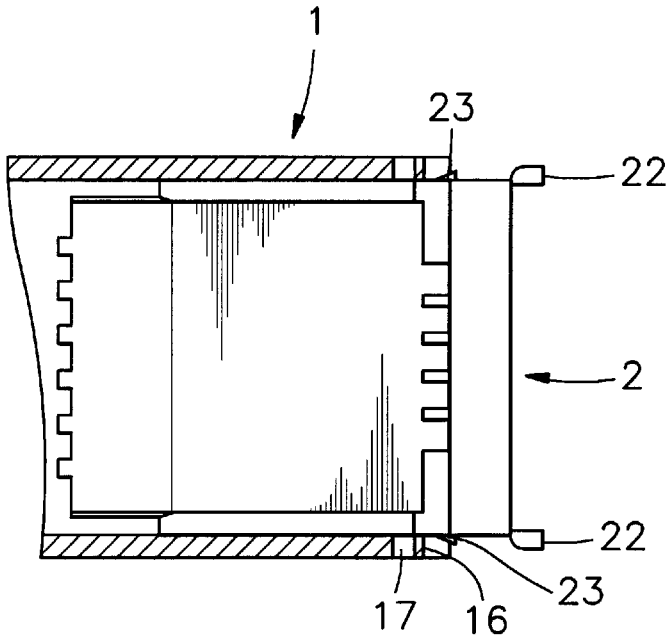
FIG. 6B is a top view in section of a part of the present invention, showing the paper currency verification unit inserted into the paper currency take-up unit.
Figure 6C:
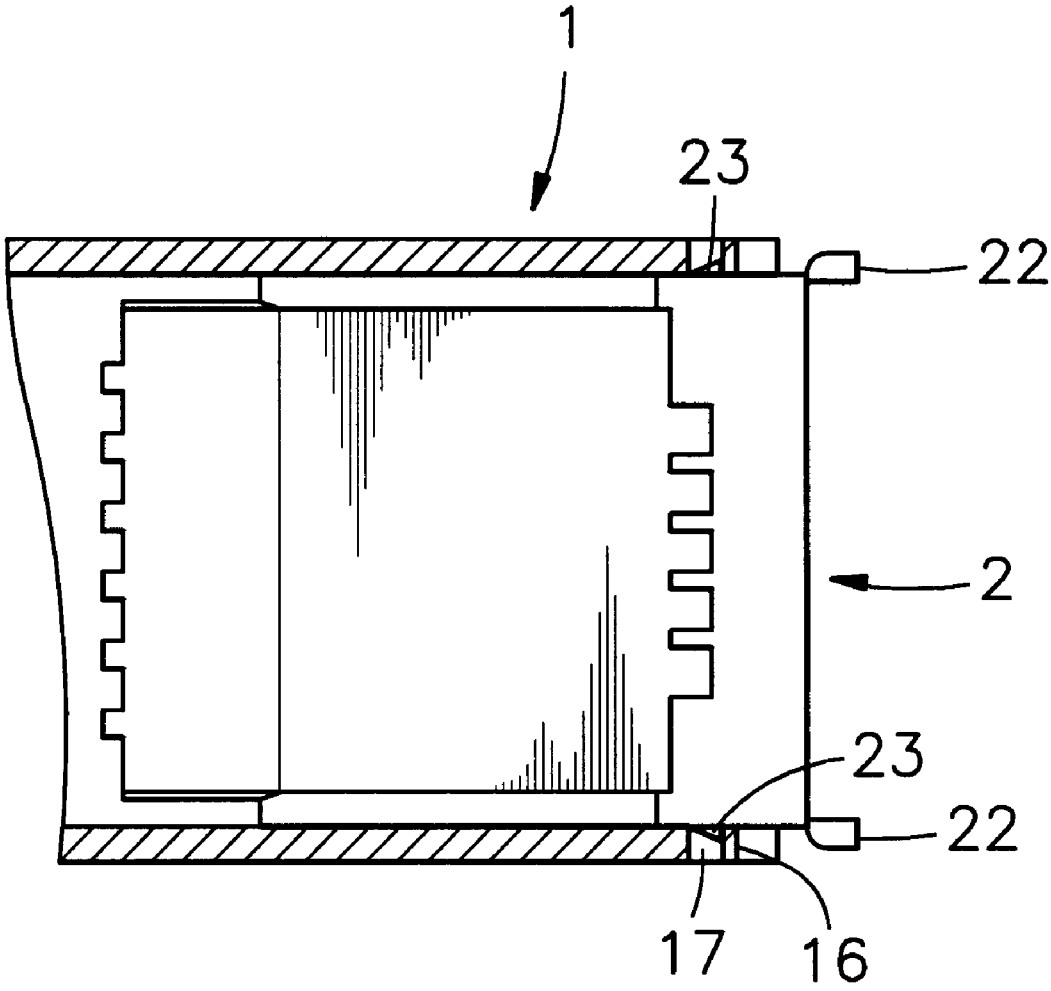
FIG. 6C is similar to FIG. 6B but showing the hooks of the coupling spring plates engaged into the corresponding retaining holes of the paper currency take-up unit.

Referring to FIGS. 4B and 4C, when detaching the paper currency storage cabinet 3 from the paper currency take-up unit 1, press the control button 41 with the fingers to force the bottom hooks 411 downwards against the beveled guide face 422 and to further move the latch block 42 backwards from the shoulder 31 of the paper currency storage cabinet 3 against the spring member 43, and therefore the paper currency storage cabinet 3 is unlocked and can be removed from the paper currency take-up unit 1.

Figure 3:
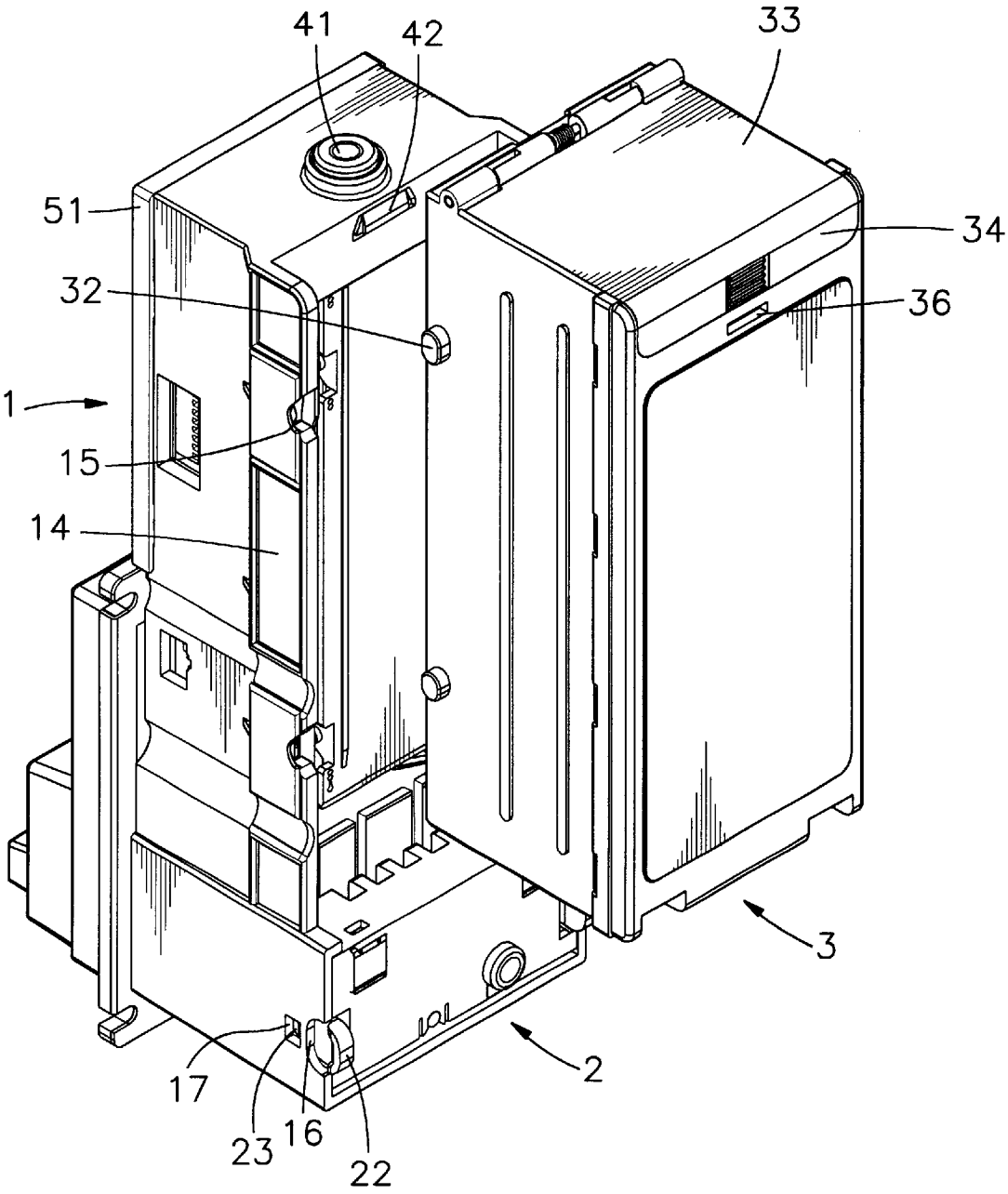
FIG. 3 is a rear elevation of the paper currency receiving system according to the present invention.

Referring to FIG. 3, the paper currency take-up unit 1 further comprises two locating notches 16 bilaterally disposed at the back side near the bottom, and two retaining holes 17 respectively disposed adjacent the locating notches 16. The paper currency verification unit 2 comprises two coupling spring plates 21 symmetrically disposed at two opposite lateral sides thereof near the back. The coupling spring plates 21 each comprise a rear finger strip 22 and a hook 23.

Referring to FIGS. 5, 6A, 6B, and 6C, when installing the paper currency verification unit 2 in the paper currency take-up unit 1, pull the finger strips 22 inwards and then insert the paper currency verification unit 2 into the paper currency take-up unit 1. After insertion of the paper currency verification unit 2 into the paper currency take-up unit 1, release the hands from the finger strips 22, enabling the hooks 23 of the coupling spring plates 21 to be respectively forced into the retaining holes 17 by the spring power of the coupling spring plates 21, and therefore the paper currency verification unit 2 is locked. By means of pulling the finger strips 22 to disengage the hooks 23 from the retaining holes 17, the paper currency verification unit 2 is unlocked and can be removed from the paper currency take-up unit 1.

Figure 7B:
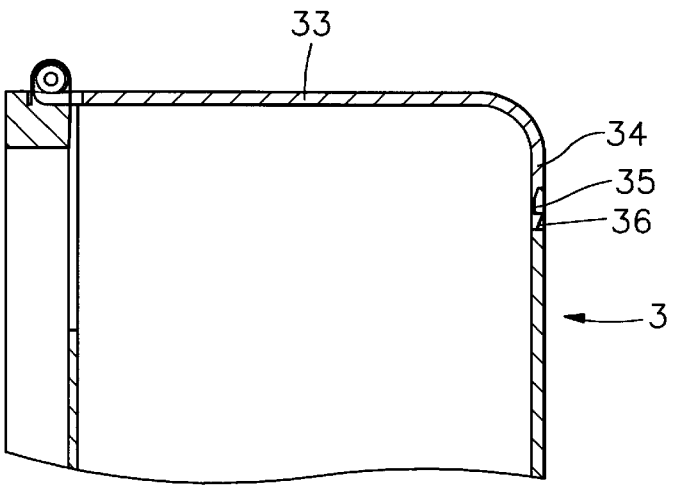
FIG. 7B is a sectional view of a part of the paper currency take-up unit of the paper currency receiving system, showing the top cover closed.
Figure 7A:
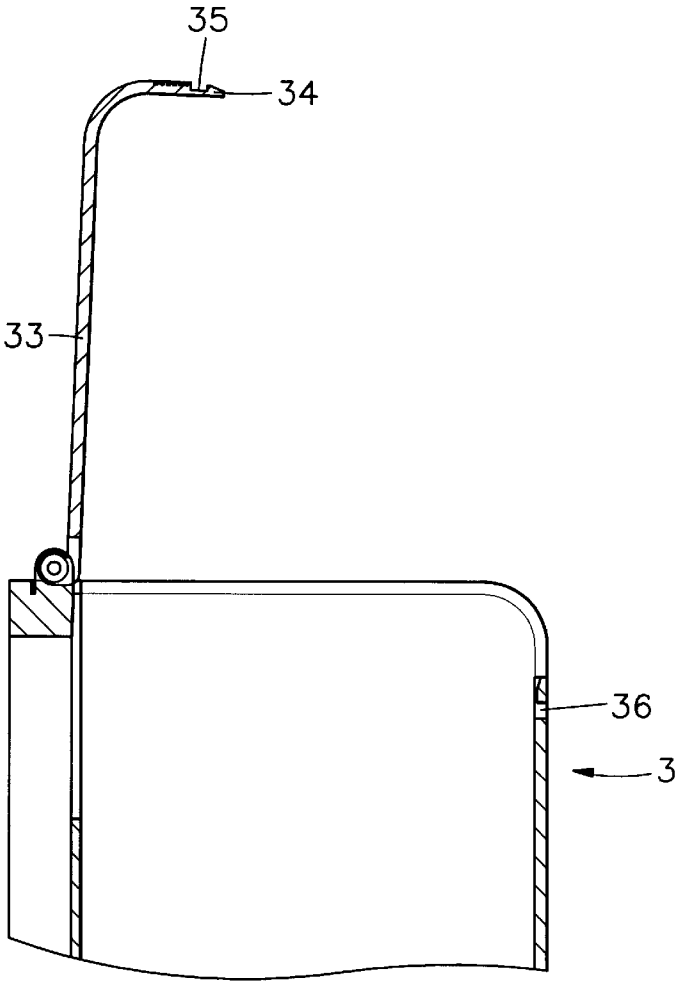
FIG. 7A is a sectional view of a part of the paper currency take-up unit of the paper currency receiving system, showing the top cover opened.
Figure 8:
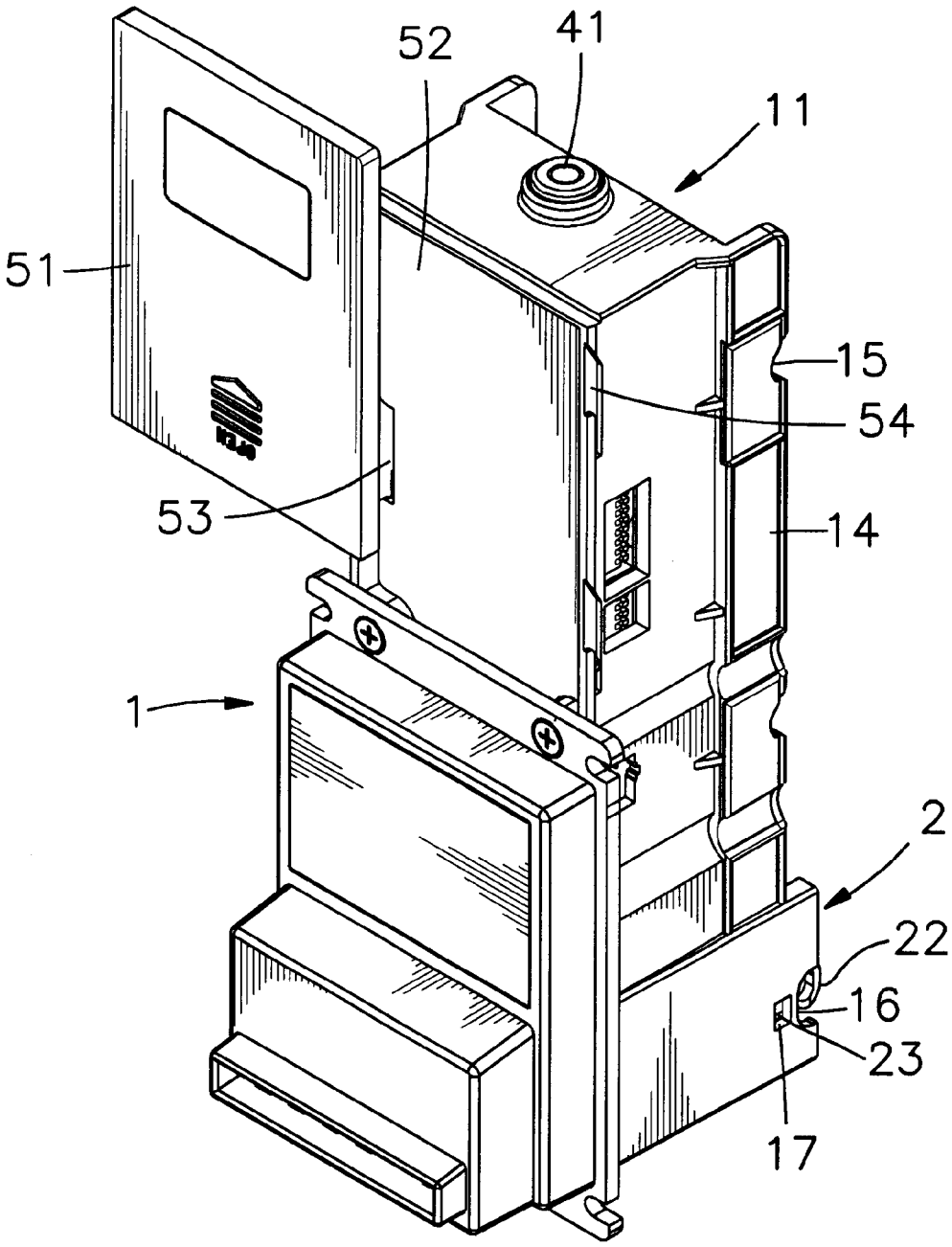
FIG. 8 is an elevational view of a part of the present invention, showing the front cover disconnected from the paper currency take-up unit.
Figure 9C:
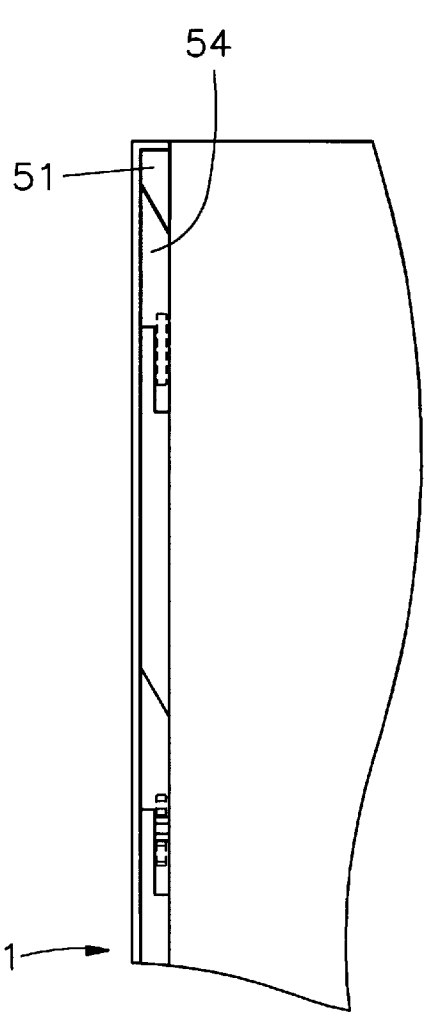
FIG. 9C shows the front cover fastened to the retaining slots of the paper currency take-up unit according to the present invention.
Figure 9B:
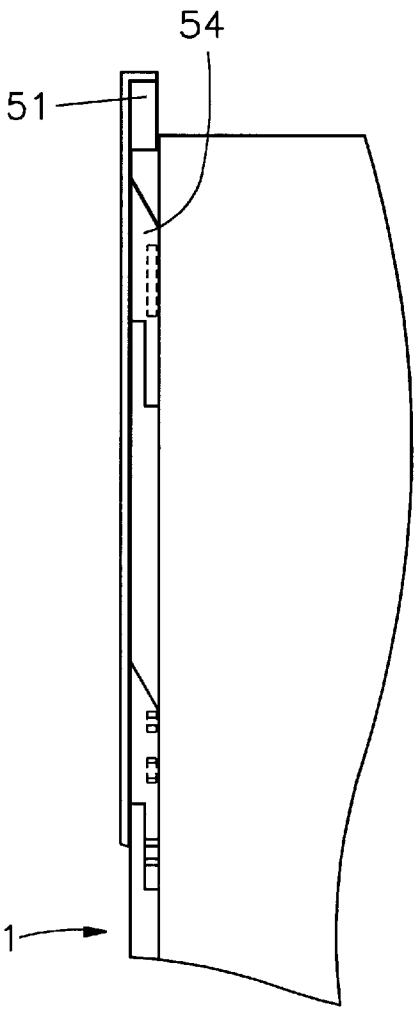
FIG. 9B shows the front cover attached to the paper currency take-up unit according to the present invention.
Figure 9A:
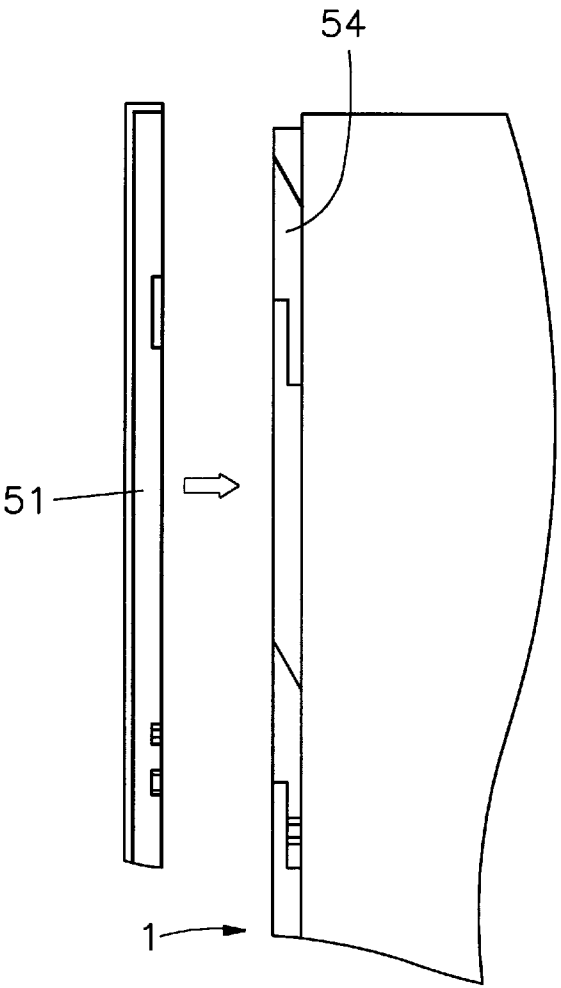
FIG. 9A is a schematic drawing showing the relation between the front cover and the paper currency take-up unit according to the present invention.

Referring to FIGS. 7A and 7B, the paper currency storage cabinet 3 comprises a top cover 33 that can be turned within 90° between the open position and the close position. The top cover 33 has a rear side (the fixed end) hinged to the top of the back sidewall of the paper currency storage cabinet 3, and an angled side (the free end) terminating in a recessed portion 35 and then a hooked portion 34. When closed, the hooked portion 34 is engaged into a retaining hole 36 in the front sidewall of the paper currency storage cabinet Referring to FIGS. 8, 9A, 9B, and 9C, the paper currency take-up unit 1 comprises a front circuit board 52, and a detachable front cover 51 adapted for covering the front circuit board 52. The detachable front cover 51 comprises a plurality of retaining lugs 53 symmetrically disposed at two opposite lateral sides thereof respectively coupled to respective retaining slots 54 in the paper currency take-up unit 1 at two opposite lateral sides of the front circuit board 52.

A prototype of paper currency receiving system has been constructed with the features of the annexed drawings of FIGS. 1–9. The paper currency receiving system functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A paper currency receiving system comprising a paper currency take-up unit adapted for taking up paper currency inserted therein, a paper currency verification unit mounted in said paper currency take-up unit at a bottom side and adapted for verifying authenticity of paper currency inserted in said paper currency take-up unit, and a paper currency storage cabinet mounted on said paper currency take-up unit at a back side and adapted to collect paper currency from said paper currency take-up unit, wherein:

said paper currency take-up unit comprises a top chamber, said top chamber comprising a top panel and a button hole in said top pan, and a lock installed in said button hole and adapted for locking/unlocking said paper currency storage cabinet, said lock comprising a spring member mounted inside said top chamber, a latch block supported on said spring member and forced by said spring member to lock said paper currency storage cabinet, and a control button for operation by the user to move said latch block backwards from said paper currency storage cabinet, said latch block comprising a top coupling hole and a beveled guide face disposed in said top coupling hole, said control button having two bottom hooks inserted through said button hole and hooked in the top coupling hole of said latch block and stopped at said beveled guide face.

2. The paper currency receiving system as claimed in claim 1 wherein said paper currency take-up unit comprises two coupling flanges bilaterally disposed at a back side of said top chamber, a plurality of L-shaped locating notches symmetrically disposed in said coupling flanges, and a plurality of retaining holes symmetrically disposed in said coupling flanges and respectively connected to said L-shaped locating notches; said paper currency storage cabinet fits the space defined between the coupling flanges of said paper currency take-up unit, comprising a plurality of locating pegs symmetrically provided at two opposite lateral sidewalls thereof and respectively inserted with said paper currency storage cabinet through said L-shaped locating notches into said retaining holes, and a shoulder backwardly protruded from a back sidewall thereof and for engagement with said latch lock of said lock of said paper currency take-up unit.

3. The paper currency receiving system as claimed in claim 1, wherein said paper currency take-up unit comprises two second locating notches bilaterally disposed at the back side thereof near a bottom side thereof and two second retaining holes respectively disposed adjacent said second locating notches; said paper currency verification unit comprises two coupling spring plates symmetrically disposed at two opposite lateral sides thereof, said coupling spring plates each comprising a hook adapted for engaging the second retaining holes of said paper currency take-up unit, a rear finger strip for operation by the user to disengage said hook from the second retaining holes of said paper currency take-up unit.

4. The paper currency receiving system as claimed in claim 1, wherein said paper currency storage cabinet comprises a top cover adapted for covering a top open side thereof and a retaining hole in a front sidewall thereof, said top cover having one side hinged to a back sidewall of said paper currency storage cabinet and a front side terminating in a hooked portion adapted for hooking in the retaining hole in the front sidewall of said paper currency storage cabinet.

5. The paper currency receiving system as claimed in claim 1, wherein said paper currency take-up unit comprises a plurality of retaining slots symmetrically disposed at two opposite lateral sides of a front circuit board thereof, and a detachable front cover adapted for covering said front circuit board, said detachable front cover comprising a plurality of retaining lugs symmetrically disposed at two opposite lateral sides thereof and adapted for engaging said retaining slots.

* * * * *